United States Patent [19]

Florio

[11] Patent Number: 4,715,936

[45] Date of Patent: Dec. 29, 1987

[54] PROCESS FOR ANODIZING ALUMINUM FOR AN ALUMINUM ELECTROLYTIC CAPACITOR

[75] Inventor: Steven M. Florio, Williamstown, Mass.

[73] Assignee: Sprague Electric Company, North Adams, Mass.

[21] Appl. No.: 595,883

[22] Filed: Apr. 2, 1984

[51] Int. Cl.[4] ..... C25D 11/08

[52] U.S. Cl. ..... 204/58; 204/58.5; 29/570.1

[58] Field of Search ..... 204/58, 58.5; 106/314.13, 314.14, 314.15, 314.18, 314.24; 29/570

[56] References Cited

U.S. PATENT DOCUMENTS

| | | | |
|---|---|---|---|
| 1,266,557 | 5/1918 | Coulson | 204/58 |
| 2,122,392 | 6/1938 | Robinson et al. | 204/58 |
| 2,166,180 | 7/1939 | Ruben | 204/58 |
| 3,524,799 | 8/1970 | Dale | 204/58 |
| 4,152,221 | 5/1979 | Schaedel | 204/27 |

FOREIGN PATENT DOCUMENTS

| | | | |
|---|---|---|---|
| 755557 | 3/1967 | Canada | 31/45 |

OTHER PUBLICATIONS

"Surface Treatment of Al" by Wernick et al., 3rd Ed., 1964, Robert Draper Ltd., p. 376.

*Primary Examiner*—R. L. Andrews

[57] ABSTRACT

An electrolyte capable of anodizing aluminum consists essentially of a solution of an amino acid having a pH of 5.5 to 8.5. The amino acid is preferably a 2-amino acid, more preferably a dicarboxylic acid, and specifically aspartic or glutamic acid. The electrolyte may be used to anodize aluminum foil to form a barrier layer oxide or as a fill electrolyte in aluminum electrolytic capacitors.

2 Claims, No Drawings

PROCESS FOR ANODIZING ALUMINUM FOR AN ALUMINUM ELECTROLYTIC CAPACITOR

BACKGROUND OF THE INVENTION

This invention relates to an electrolyte capable of anodizing aluminum and which consists essentially of a solution of an amino acid having a pH of 5.5 to 8.5. This invention relates also to an electrolyte which can be used to anodize aluminum to produce a low voltage (0–125 V) barrier layer dielectric oxide on the aluminum surface or as a fill electrolyte in low voltage (0–63 V) aluminum electrolytic capacitors. More specifically, it relates to a solution of a 2-amino acid, preferably a dicarboxylic acid, in water or an organic electrolytic capacitor solvent.

Salts of organic acids have been used as solutes in electrolytes in the aluminum electrolytic capacitor industry. Aqueous solutions of acid salts, e.g., citrates, tartrates, adipates, have been used as anodization or formation electrolytes while these and others have been used in non-aqueous operating or fill electrolytes in aluminum electrolytic capacitors.

Various problems have been encountered when the aqueous solutions of organic salts have been utilized as anodization electrolytes. In aqueous solutions of salts of $\alpha$-hydroxycarboxylic acids (e.g. tartrates, citrates etc.), the current efficiency of oxide formation is very low. In aqueous adipate solutions, the anodic oxide which is formed on aluminum is very susceptible to hydration degradation during its exposure to various working electrolytes in capacitors. In addition, while these electrolytes appear to be useful in forming a higher capacitance dielectric film on aluminum, this dielectric film is often unrelaxed, and of lower capacitance than would be truly desirable.

Several methods have been utilized to overcome the problems of low current efficiency of oxide formation, easy degradation of anodic oxide by hydration, and unrelaxed oxide formation. The problem of poor anodizing efficiency has been attacked in the past by treatment of the aluminum foil surface with boiling water or high heat (600° C.) to introduce respectively a protective hydrous or thermal oxide film prior to anodization. The problem of hydration degradation has been dealt with by performing anodization in mixed solutes, one of which imparts hydration resistance, or in stages in which an electrolyte imparting hydration resistance is used in at least one of the stages. Unrelaxed oxide films have been relaxed by boiling water treatments. Higher capacitance has been achieved also (apart from changing solutes) by introducing a hydrous or thermal oxide film prior to anodization.

The development of an electrolyte capable of directly forming a stable, high capacitance oxide on aluminum is therefore desirable.

SUMMARY OF THE INVENTION

It is a feature of this invention to provide an electrolyte which is capable of forming a stable, high capacitance anodic oxide on aluminum foil. It is another feature of the invention to provide electrolytes which are suitable for both anodizing aluminum and as operating or fill electrolytes.

These features are realized through the use of a salt of an amino acid as sole solute in the electrolyte. The amino acid is preferably a 2-amino acid, more preferably a dicarboxylic acid, and specifically aspartic or glutamic acid. The solvent may be water, commonly used in anodization electrolytes, or one of the known organic solvents used in electrolytic capacitor fill electrolytes, e.g., ethylene glycol, N,N'-dimethylformamide, 4-butyrolactone, N-methylpyrrolidinone, etc.

When used as anodization electrolytes, the amino acids produce a barrier layer oxide which is at least partially crystalline. The capacitance of the oxide layer is higher than that produced in an electrolyte such as dilute aqueous ammonium dihydrogen phosphate which does not produce much crystalline oxide. The increased capacitance appears to be associated with an increase in the ratio of crystalline to amorphous oxide formed during the anodization.

During the anodizing process, in which oxide formation is competing electrochemically with aluminum-aluminum oxide dissolution, a mostly amorphous film is formed initially in electrolytes containing aspartic, tartaric, citric acids etc. As the formation progresses, the more quickly advancing front of the thicker, more soluble amorphous oxide is dissolved in preference to the thinner, less soluble crystalline areas which have developed in the film. As the formation voltage increases, the percentage of crystalline oxide relative to amorphous oxide (which is being dissolved or converted to crystalline oxide) increases. This process, in which crystalline oxide essentially replaces amorphous oxide, leads at some voltage to a mostly crystalline oxide which is thinner and has higher capacitance.

The full capacitance enhancement effect may be realized in different electrolytes at different voltages, depending on the electrolyte solute and the charge efficiency of oxide formation in the electrolyte. In the electrolytes which contain salts of aspartic acid, the full capacitance is realized at a lower voltage than in other electrolytes, e.g., electrolytes based on salts of adipic acid, while conferring a higher degree of hydration resistance.

The formation efficiency of the amino acid electrolyte is higher than others (e.g., citrate, tartrate) known to produce a comparable amount of crystalline oxide, and thus it has been possible to use this electrolyte to anodize etched foil and obtain increased capacitance within a practical amount of time.

When a solution of the amino acid in a nonaqueous capacitor solvent is used as a fill or operating electrolyte, the formation rate is still satisfactory for it to be usable in repairing barrier layer oxide during capacitor operation.

The best results are obtained when the amino acid is partially neutralized by a basic reagent to provide a pH of 5.5 to 8.5. When the electrolyte is being used as a formation electrolyte, the basic reagent is preferably ammonia or sodium or potassium hydroxide. However, if the formation is being carried out at an elevated temperature, an amine which is less volatile than ammonia may be used instead. In this connection, the ethyl amines (mono-, di-, and tri-ethylamines) have proved satisfactory. When the electrolyte will be used as an operating electrolyte, then ammonia or an amine is used to neutralize the amino acid.

DESCRIPTION OF THE PREFERRED EMBODIMENTS

A solution of a salt of an amino acid, preferably a 2-amino acid, can be used to anodize aluminum, particularly aluminum electrolytic capacitor foil, or as a fill or operating electrolyte in aluminum electrolytic capacitors.

When the electrolyte is to be used as an aluminum anodization electrolyte, an aqueous solution of the salt of the 2-amino acid is used. The preferred amino acids are those amino analogs of hydroxy carboxylic acids which are known to have aluminum anodizing capabilities and specifically aspartic and glutamic acids.

Similarly, for fill or operating electrolytes, amino acid analogs of hydroxy carboxylic acids are suitable for operating electrolytes and have sufficient solubility in organic solvents commonly used in capacitors.

For an anodizing electrolyte, the solute concentration is 0.05 to 5 wt%, the usual concentration for anodizing electrolytes, while for an operating electrolyte it is higher and generally 5 to 10 wt%.

The following examples are typical of the electrolytes of the present invention and serve to illustrate their usefulness. Other salts of amino acids which are capable of anodizing aluminum foil may be used in place of the ones shown.

EXAMPLE 1

Aqueous anodization electrolytes containing 0.1 wt% aspartic acid and partly neutralized with ammonium hydroxide were compared with a conventional 0.1 wt% ammonium dihydrogen phosphate anodization electrolyte, with a 0.1 wt% ammonium adipate electrolyte, and with a 0.1 wt% ammonium citrate electrolyte. Electropolished aluminum foil was anodized at 1 mA/cm$^2$ constant current to 100 V at 85° C. in all electrolytes. The capacitance enhancement of the adipate, citrate, and aspartate electrolytes relative to the conventional ADP electrolyte were 17.9%, 25.3%, and 41.5%, respectively. The ratios of formation charge required in the adipate, citrate, and aspartate electrolytes to that required by the conventional ADP electrolyte were 0.97, 1.52, and 1.10, respectively. Therefore, the aspartate electrolyte conferred the highest capacitance while still allowing for efficient formation. This work was then extended to etched foil. Etched foil was anodized to 100 V in all the electrolytes at 85° C. and 1.5A constant current. Best results were obtained at pH 5.7 to 7.6 and for the experimental electrolytes were: at pH 5.7, 41.8 μF capacitance and 0.1596 μA leakage current; at pH 6.6, 43.8 μF and 0.1523 μA; and at pH 7.6, 41.9 μF and 0.1350 μA. The capacitance and leakage current for the conventional electrolyte were 29.6 μF and 0.1156 μA. The improvement in capacitance over the conventional electrolyte was 41.2%, 48.0%, and 41.6%, respectively, for the three experimental electrolytes.

A series of experiments established the optimum pH range of 5.5 to 8, preferably 5.5 to 7.6 as shown above. Above and below these values, capacitance decreased. The electrolyte is useful from 25° C. to its boiling point (approximately 100° C. for an aqueous solution) but the lower temperatures are more difficult to control, particularly with the exothermic anodization reaction. It is therefore desirable to optimize the process at a higher temperature, namely about 85° C., where local overheating will have little effect on product quality and reaction time is suitable for integration into existing manufacturing process sequences.

Other series of experiments established that the amino acid concentration should be in the range of 0.05 to 5 wt%, with 0.1 to 3.5 wt% preferred.

EXAMPLE 2

Two typical fill or operating electrolytes were formulated in N,N'-dimethylformamide and in ethylene glycol. Each contained 8.1 wt% aspartic acid and 6.5 wt% water. The DMF electrolyte had a pH of 7.4, a resistivity of 2780Ω-cm and a maximum formation voltage of 350 V at 25° C. and 275 V at 85° C., while the glycol electrolyte had a pH of 8.4, a resistivity of 670Ω-cm, and a maximum formation voltage of 200 V at 25° C. and 150 V at 85° C. The glycol electrolyte would be suitable for a 100 V capacitor and the DMF electrolyte would be suitable for 200 V service.

By varying the solvent and the amount of the solute, a variety of operating electrolytes may be prepared for a range of voltages and operating temperatures.

What is claimed is:

1. A process for anodizing aluminum for an aluminum electrolytic capacitor, said process comprising applying an anodization voltage while passing aluminum capacitor foil through a bath wherein the only anodizing ion is present as 0.05 to 5 wt% of a dicarboxylic acid selected from aspartic acid and glutamic acid dissolved in an aqueous solvent at a temperature of 25° to 100° C. and neutralized to a pH of 5.5 to 8 by a basic reagent selected from sodium hydroxide, potassium hydroxide, ammonia, ethylamine, diethylamine, and triethylamine, thereby forming a partially crystalline barrier layer dielectric oxide on said aluminum capacitor foil.

2. A process according to claim 1 wherein said temperature is 85° C., said pH is 7, said amino acid is aspartic acid, and 0.1 to 3.5 wt% of said acid is present.

* * * * *